US006530321B2

(12) United States Patent
Andrew et al.

(10) Patent No.: US 6,530,321 B2
(45) Date of Patent: Mar. 11, 2003

(54) FLEXIBLE IMAGE TRANSFER BLANKET HAVING NON-EXTENSIBLE BACKING

(75) Inventors: Robert L. Andrew, Gastonia, NC (US); Philip K. Loyer, Waynesville, NC (US); Dawn Kopecky, Port Edwards, WI (US); Michael E. McLean, Etowah, NC (US); Edward P. Dzierzynski, Skyland, NC (US); Dennis R. Wolters, Dayton, OH (US)

(73) Assignee: Day International, Inc., Dayton, OH (US)

( * ) Notice: Subject to any disclaimer, the term of this patent is extended or adjusted under 35 U.S.C. 154(b) by 82 days.

(21) Appl. No.: 09/809,528

(22) Filed: Mar. 15, 2001

(65) Prior Publication Data

US 2001/0032560 A1 Oct. 25, 2001

Related U.S. Application Data

(60) Provisional application No. 60/190,948, filed on Mar. 21, 2000.

(51) Int. Cl.[7] ..... B41F 27/06

(52) U.S. Cl. ..... 101/376; 101/377; 101/378

(58) Field of Search ..... 101/376, 378, 101/382.1, 383, 389.1, 415.1

(56) References Cited

U.S. PATENT DOCUMENTS

| | | | | |
|---|---|---|---|---|
| 2,752,280 A | | 6/1956 | Cooke et al. | |
| 3,235,772 A | | 2/1966 | Gurin | |
| 5,066,537 A | | 11/1991 | O'Rell et al. | |
| 5,188,031 A | | 2/1993 | Depa et al. | |
| 5,357,863 A | * | 10/1994 | McLean et al. | 101/389.1 |
| 5,456,171 A | | 10/1995 | Biava et al. | |
| 5,498,470 A | | 3/1996 | McLean et al. | |
| 5,687,648 A | | 11/1997 | Puschnerat et al. | |
| 5,749,298 A | | 5/1998 | Castelli et al. | |
| 5,754,931 A | | 5/1998 | Castelli et al. | |
| 5,934,194 A | | 8/1999 | Puschnerat et al. | |

FOREIGN PATENT DOCUMENTS

| | | |
|---|---|---|
| EP | 317656 | 5/1989 |
| EP | 388740 | 9/1990 |
| EP | 676301 | 10/1995 |
| GB | 1505623 | 3/1978 |
| GB | 2 167 011 A | 5/1986 |
| JP | 59 209198 | 11/1984 |
| JP | 60225799 | 11/1985 |
| WO | WO 93/01003 | 1/1993 |
| WO | WO 9402259 | 2/1994 |

* cited by examiner

*Primary Examiner*—Raquel Yvette Gordon
*Assistant Examiner*—An H. Do
(74) *Attorney, Agent, or Firm*—Killworth, Gottman, Hagan & Schaeff, LLP

(57) ABSTRACT

A flexible image transfer blanket is provided which has a non-extensible backing which is easy to mount onto conventional blanket cylinders, which requires no packing (but which can be used with packing), which does not need to be retensioned during operation, and which prints to the gap better than conventional fabric-reinforced blankets. The image transfer blanket is adapted to be mounted onto a blanket cylinder and includes first and second ends, with at least one of the first and second ends being adapted to be inserted into an axially-extending gap in the blanket cylinder. The blanket includes a image transfer surface layer, at least one woven fabric ply, and a non-extensible base layer. The at least one woven fabric ply includes both warp and weft fibers, with the weft fibers being oriented so that when the blanket is mounted on the blanket cylinder the weft fibers extend circumferentially about the blanket cylinder.

25 Claims, 6 Drawing Sheets

FLEXIBLE IMAGE TRANSFER BLANKET HAVING NON-EXTENSIBLE BACKING

CROSS REFERENCE TO RELATED APPLICATIONS

This patent application claims the benefit of U.S. Provisional Application Ser. No. 60/190,948, filed Mar. 21, 2000.

BACKGROUND OF THE INVENTION

The present invention generally relates to an image transfer blanket construction to be used principally in offset printing systems, and more particularly to an image transfer blanket which is flexible and yet which has a non-extensible backing.

In offset lithography, a rotary cylinder is covered with a printing plate which normally has a positive image area which is receptive to oil-based inks and repellent to water and a background area where the opposite is true. The printing plate is rotated so that its surface contacts a second cylinder covered with a rubber-surfaced ink-receptive printing blanket (sometimes also called a printer's blanket, or broadly an image transfer blanket). One common type of printing blanket is one which is manufactured as a flat, fabric reinforced sheet having an elastomeric, ink-receptive surface. The ink present on the image surface of the printing plate transfers, or offsets, to the surface of the blanket. Paper or other sheet stock to be printed is then passed between the blanket-covered cylinder and a rigid back-up cylinder to transfer the image from the surface of the blanket to the paper.

During the step in which the inked image is transferred from the plate to the blanket and the step where the image is transferred from the printing blanket to the paper, it is important to have intimate contact between the two contacting surfaces. An exact amount of interference pressure is required so that the blanket contacts and removes ink from the printing plate and transfers the inked image to a proper depth into the paper. This is ordinarily achieved by positioning the blanket-covered cylinder and the supporting cylinder it contacts so that there is a fixed interference between the two and so that the blanket is compressed throughout the run to a fixed depth, typically approximately 0.05 to 0.10 mm (0.002 to 0.004 inches). It is important that this compression be maintained uniformly over the entire surface of the blanket.

Within the current state of the art, all conventional printing blankets lose thickness (i.e., lose gauge or "sink") when they are initially tensioned and installed, and further lose thickness as the blanket is repeatedly exposed to the interference pressures at the nips between the printing cylinder and blanket-covered cylinder and the blanket-covered cylinder and rigid back-up cylinder, respectively. Blankets can fail catastrophically due to blanket smash, a permanent deformation in a portion of the entire blanket surface, or from a gradual deterioration of blanket gauge over time due to the repeated cycling of the interference pressures on the blanket's surface. When the thickness of a blanket recedes beyond the limits of press adjustment, the print pressure becomes insufficient to cause transfer of the inked image from the print cylinder to the blanket or the blanket to the paper, or both. Thus, for a typical blanket, a permanent loss of thickness of as little as 0.05 to 0.10 mm (0.002 to 0.004 inches) may require a press stoppage. Such problems are even more severe at or near the gap in the cylinder because there is a tendency of the blanket to "fall off" into the gap (i.e., lose the thickness needed to offset the image to the web).

Conventionally, the fixed interference described above is accomplished by inserting one or more thin layers of paper or the like between the blanket and the surface of the blanket cylinder to build up the thickness of the blanket. This process is known as packing a blanket. Once the gauge loss of the blanket reaches a certain amount, as described above, additional thickness must be supplied under the blanket. This involves stopping the press, demounting the blanket and original packing, repacking, and then remounting and retensioning the blanket.

The packing process presents problems however in that the procedure is time consuming, resulting in down time for the printing equipment. Typically, press downtime can cost from several hundred to over a thousand dollars per hour. It may take over 30 minutes to pack or repack a blanket. Further time is lost as the system is retuned to optimum settings. Additionally, once positioned on the cylinder, the packing paper tends to slide, slip, and/or fold which may render the blanket surface nonuniform and result in poor printing results.

To avoid some of the problems associated with packed blankets, some press operators, and in particular news press operators, have used blankets which do not require packing. So-called "no pack" blankets have been developed to provide a fixed interference without the need to pack the blanket. No pack blankets are manufactured to very precise gauges so that they can be installed directly onto a blanket cylinder with the correct amount of interference. These blankets have the advantage of a one-piece construction which requires no positioning of packing paper beneath the blanket. This results in less down time for the printing equipment when an old blanket is removed and replaced with a new blanket.

Such no pack blankets, like most printing blankets, are normally composed of a base material which gives the blanket dimensional stability. Woven fabrics are preferred. The base typically includes two or more layers of such fabric adhered together. The working surface of the blanket which contacts the ink is typically an elastomeric layer of natural or synthetic rubber which is applied over the base layer or layers. The base layers and working surface are laminated together using suitable adhesives. Again, such blankets exhibit some gauge loss upon initial tensioning and installation and continue to lose thickness over time during use. However, once the gauge (thickness) loss on a no pack blanket exceeds the limits of press adjustment, the blanket becomes unusable without recourse and must be replaced by a new blanket.

An important goal in offset printing is to increase the operating speeds of printing presses in order to maximize production. Typically, conventional flat printing blankets are manufactured so that their ends can be mounted and secured into a relatively wide gap or groove in the blanket cylinder. The gap runs in the axial direction, and the leading and trailing ends of the blanket are inserted into the gap and secured by any of a number of techniques including lock-up mechanisms and clamps. Typically, the leading and trailing ends of the blanket are generally reinforced with strips of metal known as blanket bars to stiffen the blanket ends and facilitate insertion of the blanket into the lock-up mechanism.

However, the need for a gap in the blanket cylinder has resulted in problems when the speed of the cylinder is increased, as the cylinder is unbalanced (i.e., weight is unevenly distributed), and the blanket itself is subjected to increased stresses. This can result in vibrations and shock loading of the blanket, reducing print quality. Newer higher speed presses have appeared which have addressed these problems by providing a smaller gap in the blanket cylinder, sometimes known as "mini-gap" presses. Thus, shock loading can be reduced by making the cylinder gap as narrow as possible. Conventional cylinder gap widths, i.e., for use with fabric backed blankets, range from about 5 mm to about 10 mm in width. To address the need for narrow gap blanket cylinders, newer types of printing blankets have been developed. Such blankets are known in the art as metal-backed blankets (see, e.g., International Publication No. WO 93/01003 of Pinkston et al.) which rest upon and are supported by, a thin metal sheet. Metal-backed blankets can be mounted on cylinders with gaps that are less than 3 mm wide. Blanket cylinders having these much-narrower gaps can operate at high speeds with a reduced incidence of shock loading. A further advantage of such narrow gap cylinders is that there is less web area wasted in printing as the print can extend to the narrow gap.

A metal-backed printing blanket typically comprises a base layer of a thin, flat, flexible sheet of metal and a top layer comprising an elastomer such as rubber. Other layers may be sandwiched between the base and top layers, formed of materials such as fabric, after which these multiple layers are laminated together. Such a blanket conventionally has a thickness of about 2 mm, of which about 0.20 mm may be attributed to the thickness of the metal base plate. One configuration of a metal-backed blanket manufactured and sold by KBA (Koenig & Bauer-Albert AG, of Frankenthal, Germany) has a small strip of exposed metal at the leading and trailing edges of the blanket adapted for insertion into the cylinder gap. See, e.g., Puschnerat et al, U.S. Pat. Nos. 5,687,648 and 5,934,194. See also, Castelli et al, U.S. Pat. No. 5,749,298.

Because the thickness of the metal edges is much less than the thickness of the rest of the blanket, the edges may be inserted into a cylinder gap that is much narrower than the gap that is needed to accommodate the thickness of more conventional blankets. However, metal-backed blankets have introduced their own set of problems, including the need for different lock-up mechanisms to avoid blanket pull out during printing operations (i.e., an end of the blanket releases from the lock-up mechanism from the gap). Further, it has not been possible to use these metal-backed blankets on conventional presses because the metal ends will not secure into the conventional lock-up mechanisms found in existing blanket cylinders.

Simply adding a co-extensive metal base layer to a conventional fabric-reinforced printing blanket is not practical as the resulting blanket becomes extremely difficult to mount and tension properly on the blanket cylinder. This is because the added metal, particularly on the leading and trailing ends of the blanket, is relatively inflexible and difficult to feed into the cylinder gap, and the overall blanket is difficult to wrap securely about the blanket cylinder.

Accordingly, there remains a need in the art for an image transfer blanket which resists gauge loss throughout its useful life. Such a blanket would reduce expensive down time for press operators and require fewer adjustments of the press during operation. Further, there remains a need in the art for a such an image transfer blanket which can be retro-fitted onto existing offset presses.

SUMMARY OF THE INVENTION

The present invention meets those needs by providing a flexible image transfer blanket which has a non-extensible backing which is easy to mount onto conventional blanket cylinders, which requires no packing (but which can be used with packing), which does not need to be retensioned during operation, and which prints to the gap better than conventional fabric-reinforced blankets. By "non-extensible" we mean a material which will not elongate under tensions typically used (i.e., typical lock-up mechanisms for image transfer blankets are subjected to a torque force of from between about 2 to about 120 ft-lbs (about 2.7 to about 162 Newton-meters) and apply a tension of from about 100 to about 250 pounds per lineal inch (about 17.8 to about 45 kg/cm)) in the mounting of image transfer blankets. By comparison, typical fabric-reinforced image transfer blankets will elongate by from about 1.25% to about 2.5% of their initial length when subjected to conventional tensioning forces, depending on the particular blanket construction. The image transfer blanket of the present invention is suitable for use with both web-fed and sheet-fed presses.

In accordance with one aspect of the present invention, an image transfer blanket which is adapted to be mounted onto a blanket cylinder is provided and includes first and second ends, with at least one of the first and second ends being adapted to be inserted into the axially-extending gap in the blanket cylinder. The blanket includes an image transfer surface layer, at least one woven fabric ply, and a nonextensible base layer. The at least one woven fabric ply includes both warp and weft fibers, with the weft fibers being oriented so that when the blanket is mounted on the blanket cylinder the weft fibers extend circumferentially about the blanket cylinder. By "warp" fibers, it is meant those fibers which extend lengthwise and which are under tension on a loom or other weaving device. By "weft" fibers, it is meant those fibers which are woven around the warp fibers in the fabric. Weft fibers are also sometimes known in the art as pick, fill, or woof fibers. As used herein, the terms fibers and yams are used interchangeably, with fibers referring both to single fibers as well as multiple fiber bundles. By orienting the warp and weft fibers in the fabric ply in this manner, namely so that the weft fibers are oriented around the blanket cylinder when the blanket is mounted, there is sufficient residual elongation in the weft fibers to provide flexibility for bending of the other layers in the blanket in either direction.

Preferably, the blanket includes at least one blanket bar secured to at least one end of the image transfer blanket. Blanket bars are used to secure one or both end of a blanket into the axially-extending gap in the blanket cylinder when the blanket is mounted thereon. A preferred embodiment of the invention includes at least two woven fabric layers in the blanket construction, with at least one of the woven fabric layers, and preferably both of the fabric layers, being oriented such that when the blanket is mounted on the blanket cylinder the weft fibers extend circumferentially about the blanket cylinder.

The base layer is selected from the group consisting of metals and alloys thereof, synthetic polymer resins, and fiber-reinforced synthetic polymer resins. A preferred base layer material comprises steel, polyester, or fiberglass reinforced polymer resin. The blanket construction may also optionally contain a compressible layer.

In accordance with the present invention, the blanket may include a number of features which aid in mounting and securing the blanket on a blanket cylinder. For example, the nonextensible base layer may extend beyond the image transfer surface layer and the woven fabric ply at at least one end thereof. That portion of the nonextensible layer which extends beyond the at least one end of the blanket may be bent such that such portion is adapted to be inserted into the axially-extending gap of the blanket cylinder. That portion of the nonextensible layer may also have a blanket bar secured thereto.

Alternatively, the image transfer surface layer and the woven fabric ply may extend beyond the nonextensible base layer at at least one end thereof. The fabric ply may then be secured within the gap in the blanket cylinder using conventional lock-up mechanisms as are known in this art.

In another embodiment of the invention, a smash-resistant image transfer blanket may be provided and includes an image transfer surface layer, at least one woven fabric ply, and a nonextensible base layer. The at least one woven fabric ply is impregnated with an elastomeric composition and includes warp and weft fibers, the weft fibers being oriented so that when the blanket is mounted on the blanket cylinder the weft fibers extend circumferentially about the blanket cylinder. The elastomeric composition displaces the air in the interstices between the warp and weft fibers to prevent the blanket surface from sinking when subjected to the compressive forces encountered during printing.

Accordingly, it is a feature of the present invention to provide an image transfer blanket which resists gauge loss throughout its useful life. It is a further feature of the invention to provide a blanket which reduces expensive down time for press operators and requires fewer adjustments of the press during operation. It is another feature of the invention to provide a blanket which can be retro-fitted onto existing offset presses. These, and other features and advantages of the present invention, will become apparent from the following detailed description, the accompanying drawings, and the appended claims.

BRIEF DESCRIPTION OF THE DRAWINGS

The present invention will be more readily understood by reference to the accompanying drawing figures which are provided by way of non-limiting example and in which.

DETAILED DESCRIPTION OF THE PREFERRED EMBODIMENTS

Figure 1:
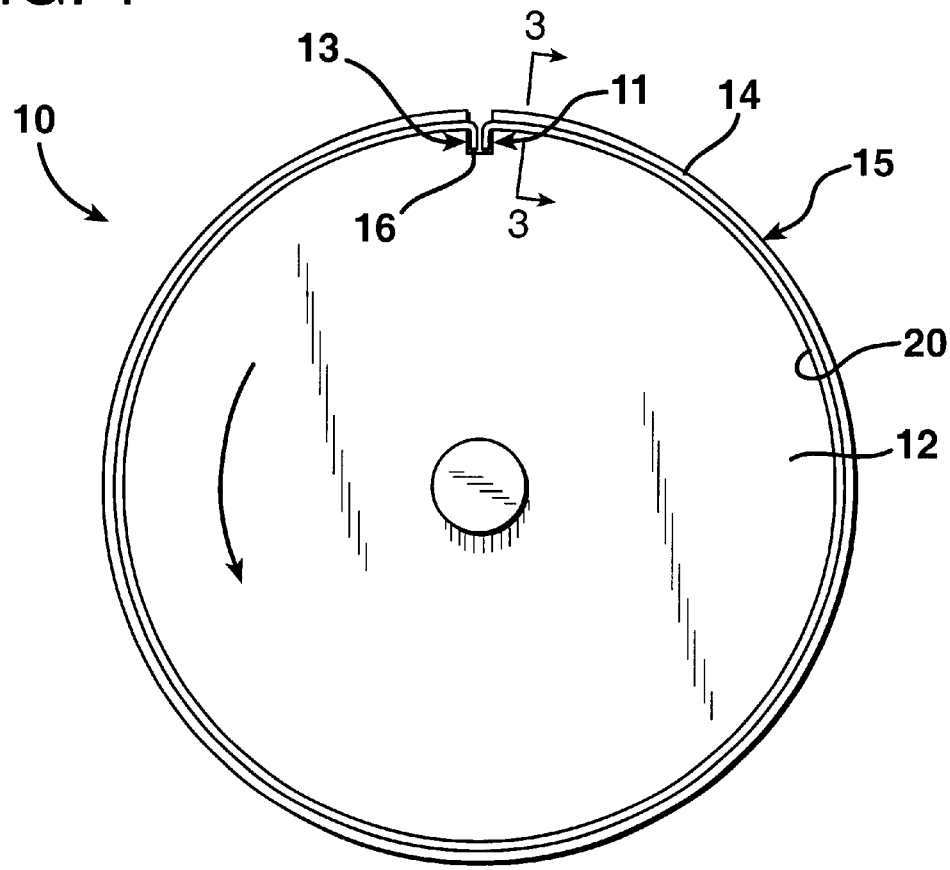
FIG. 1 is a schematic side view of one embodiment of the image transfer blanket of the present invention mounted on a blanket cylinder.

FIG. 1 generally illustrates a portion of a typical offset lithographic printing apparatus 10 which includes a blanket cylinder 12 and a image transfer blanket 15 mounted thereon. The blanket cylinder 12 includes an axially-extending gap 16 having first and second edges 11 and 13, respectively, which form a gap having a width W (see FIG. 2). Image transfer blanket 15 includes a plurality of layers or plies 14, different embodiments of which are shown in greater detail in FIGS. 3–5, secured to an underlying non-extensible base layer 20.

Figure 2:
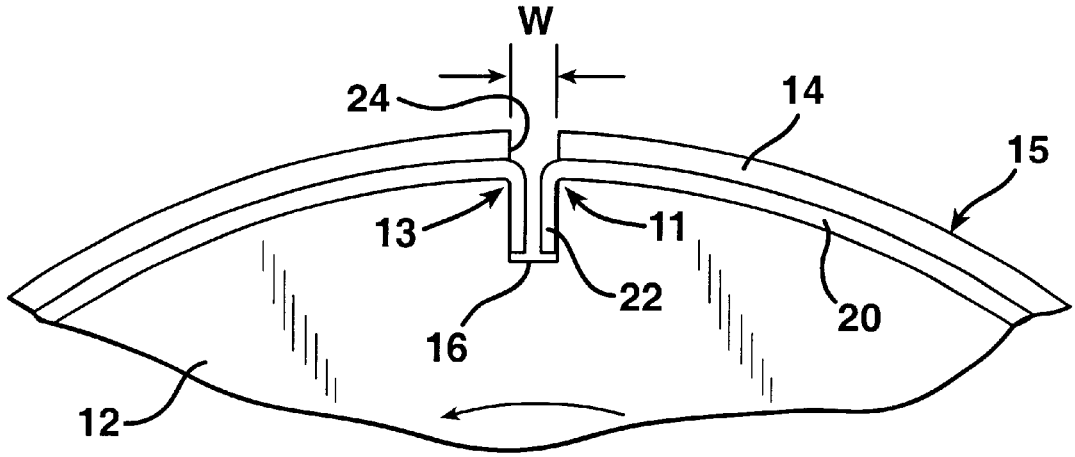
FIG. 2 is an enlarged view of a portion of the image transfer blanket of FIG. 1, showing additional detail of the blanket cylinder and axially-extending gap into which the ends of the image transfer blanket are mounted.

FIG. 2 is an enlarged view of one embodiment of image transfer blanket 15 in the area of gap 16. In this embodiment, leading and trailing ends 22 of base layer 20 extend beyond the length of other plies 14 and are bent so that ends 22 are inserted into gap 16 to secure blanket 15 to blanket cylinder 12. As shown in FIG. 2, ends 22 are bent at an approximately 90° angle to the remaining portion of the blanket. However, it will be appreciated that this angle may vary depending upon the size and orientation of gap 16. Typically, the angle may vary from between about 45° to about 135°. The ends of the blanket may be pre-bent as manufactured, or may be bent at the time of installation.

Figure 15:
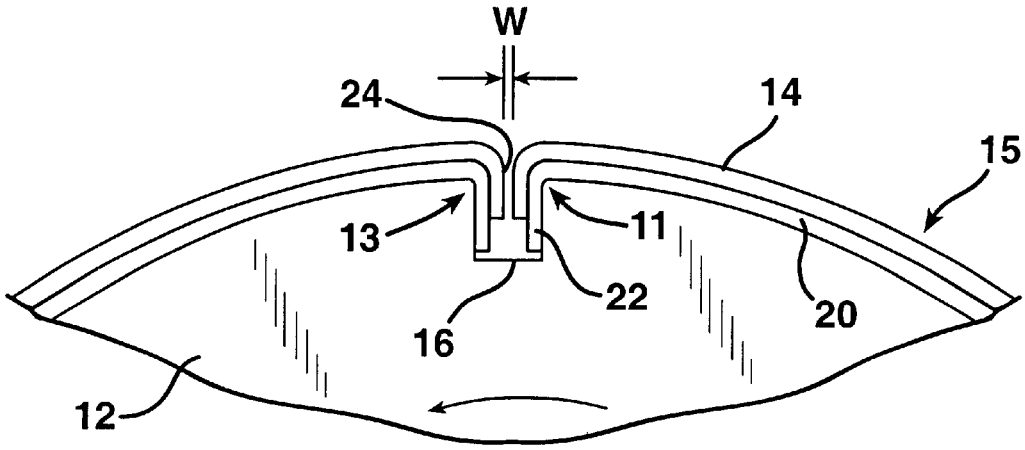
FIG. 15 is an enlarged side view of a different embodiment of the image transfer blanket mounted on a blanket cylinder.

FIG. 15 illustrates a different embodiment of the invention similar to that illustrated in FIG. 2, and where like numerals refer to like elements. However, in the embodiment shown in FIG. 15, the fabric and polymer plies 14 extend at least partially into gap 16. In this embodiment, the fabric and polymer plies are selected and constructed to permit then bending of the plies into the gap without breaking or cracking. Again, while ends 22 are shown as being bent at an approximately 90° angle to the remaining portion of the blanket, it will be appreciated that this angle may vary depending upon the size and orientation of gap 16. Typically, the angle may vary from between about 45° to about 135°. Also again, the ends of the blanket may be pre-bent as manufactured, or may be bent at the time of installation.

Figure 3:
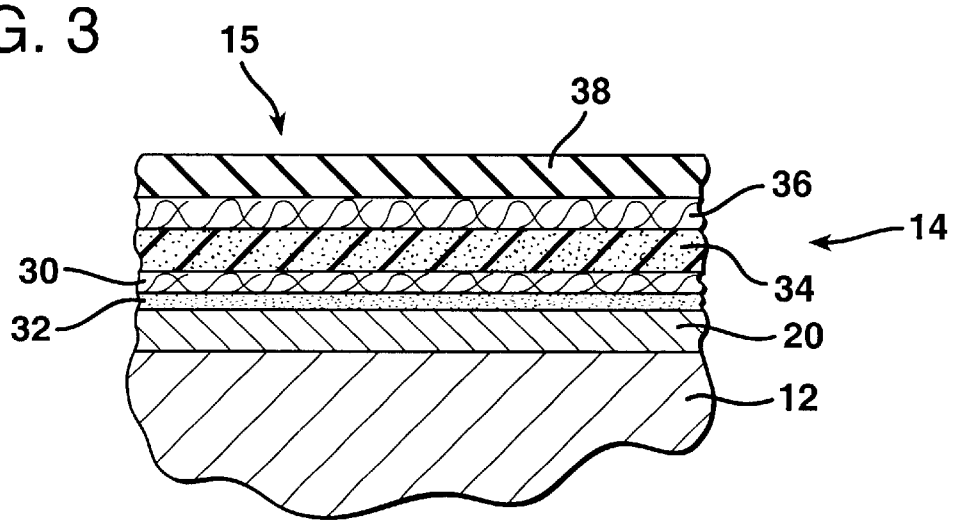
FIG. 3 is a fragmentary side view in cross-section of an embodiment of the image transfer blanket of the invention taken along line 3—3 in FIG. 1.

Referring now to FIG. 3, a more detailed cross-sectional view of one embodiment of the components of the image transfer blanket 15 is illustrated. The plies 14 may include a woven fabric ply 30, a first side of which is secured to the nonextensible base layer 20 with an adhesive material 32. The plies 14 further include an optional compressible layer 34 which is disposed on a second side, opposite to the first side of woven fabric ply 30, and a second woven fabric ply 36 mounted onto the second side of the compressible layer 34. The outer surface of the image transfer blanket 15 preferably comprises an elastomeric image transfer surface layer 38 mounted onto woven fabric ply 36. Preferably, the blanket has an overall thickness of from between about 0.070 to about 0.90 inches (from about 17.5 to about 23.0 mm).

The plies 14 are terminated at the edges 11 and 13 of gap 16 as shown in FIG. 2. The plies 14, however, can have an edge treatment at the edges 11 and 13 to prevent fluids encountered during the image transfer operations from infiltrating into the plies 14 of the image transfer blanket 15 and causing delamination thereof. Such an edge treatment may be accomplished using conventional blanket sealers which are well known in the art.

Base layer 20 comprises a flexible, but nonextensible, material. Preferably, layer is selected from among metals and metal alloys, synthetic polymer resins, and fiber-reinforced synthetic polymer resins. Such reinforcing fibers include glass, carbon, natural (e.g., cotton), and synthetic (e.g., aramid, polyester). A preferred material for layer 20 comprises stainless steel having a thickness of from between about 0.006 to about 0.010 inches (0.15 to about 0.25 mm) which is readily commercially available. Alternatively, base layer 20 may comprise a polyester resin. Base layer 20 preferably has a thickness in a range from about 0.1 mm to about 0.4 mm, and most preferably, a thickness of between about 0.2 to 0.3 mm. However, those skilled in the art will recognize that, depending upon the flexibility of a given base material, preferred thicknesses may vary somewhat above and below the stated range.

Preferably, the adhesive material 32 has a thickness of from approximately 0.001 to 0.008 inches (about 0.025 mm to about 0.2 mm) and comprises a polyester hot melt film material which can be applied and then heated to an elevated temperature to activate its adhesive properties. Although the adhesive material 32 may comprise any adhesive material, it preferably comprises a hot melt, polyester-based adhesive which is commercially available from a variety of sources. For example, a preferred adhesive material 32 may comprise a modified co-polymer of ethylene and vinyl acetate in the form of a hot-melt film.

Woven fabric ply 30 may be partially or entirely ground to adjust the thickness thereof. Fabric plies 30 and 36 have thicknesses, respectively, preferably in a range from about 0.008 to about 0.016 inches (from about 0.15 to about 0.4 mm) and most preferably, a thickness of about 0.011 inches (0.28 mm). Fabric ply 30, as well as fabric ply 36, comprise fabrics woven from cotton or synthetic yarns or fibers having both warp and weft fibers or yarns. One preferred fabric for use in the present invention is a square woven fabric in which the warp yarns are cotton (such as, for example, pima cotton) and the weft yarns are polyester (such as a spun polyester). The fabric is pre-stretched in a single direction along the length of the warp yarns such that the fabric as used in the manufacture of the image transfer blanket has little or no residual stretch in that direction.

As shown, either or both of woven fabric plies 30 and 36 are oriented in the blanket construction so that when the blanket is mounted onto blanket cylinder 12, the weft fibers extend circumferentially about the cylinder. This orientation is 90° from the orientation of conventional fabric plies in a blanket (as that blanket would be mounted onto a cylinder) and provides the necessary flexibility for the base layer 20. In prior blanket constructions, it was conventional to bond two woven fabric plies as reinforcing base plies in the blanket. Such a construction resisted flexing and bending of the blanket in either direction. Such a construction, when combined with a nonextensible base layer, would be difficult to bend and install onto a conventional blanket cylinder.

With respect to the compressible layer 34, any known compressible or resilient material compatible with the other plies may be used in accordance with the invention. A preferred compressible layer 34, comprises a blend of nitrile and chloroprene-based rubber having a pore density to provide adequate strength and compressibility. Compressible layer 34 may comprise either open or closed-cell foam, with closed cell foams being preferred. Suitable compressible layer materials and their methods of fabrication include those materials disclosed in commonly-assigned U.S. Pat. No. 4,548,858 to Meadows, the disclosure of which is hereby incorporated by reference.

In another alternative embodiment, the cushion layer may be formed by mixing a suitable salt such as hydrated magnesium sulfate with a polymeric material such as rubber and then curing and leaching the salt out, forming cavities in the rubber. Such a process is disclosed in commonly assigned U.S. Pat. No. 3,928,521 to Haren et al, the disclosure of which is hereby incorporated by reference. Still another method of forming the cushion layer includes the incorporation of microcapsules in an elastomeric matrix and fixing those microcapsules in a low temperature partial vulcanization step as described in U.S. Pat. No. 4,770,928 to Gaworoski, the disclosure of which is hereby incorporated by reference. Preferably, compressible layer 34 will have a thickness in a range from about 0.022 to about 0.026 inches (from about 0.56 mm to about 0.67 mm) and most preferably, a thickness of about 0.245 inches (0.62 mm). This thickness is about twice the thickness of a typical compressible layer in a conventional image transfer blanket.

Lastly, elastomeric image transfer surface layer 38 provides the image transfer face for the image transfer blanket 15. The surface of layer 38 may be ground to provide the final gauge thickness for the blanket. Suitable materials for use in the fabrication of image transfer surface layer 38 include a number of different polymers such as butyl rubber, EPDM rubber, nitrile rubber, natural rubber, neoprene rubber, a blend of nitrile and polyvinyl chloride, polyurethane, and synthetic rubber.

Those skilled in the art will appreciate that the preferred materials and their respective thickness may be varied or substituted without departing from the invention. For example, additional adhesive, primer, anchor, and ply up layers may be provided in the blanket construction as needed and as is conventional in this art.

A preferred method for securing the plies 14 to nonextensible base layer 20 is to first remove any oils or other contaminants from the surface of base layer 20 and then apply a primer to prevent the reoccurrence of surface contamination and increase the ability of the adhesive film material 32 to bond. The adhesive film material 32, preferably a hot-melt polyester material as described above, is interleaved between woven fabric ply 30 and base layer 20. It should be understood, however, that it is possible to apply an initial layer of the polyester material to a side of the fabric ply 30 to which base layer 20 is adhered so as to provide a "priming" adhesive film layer. Thereafter, the plies 14 and base layer 20 are heated and then cooled to set the adhesive film material 32, thus adhesively securing the plies 14 to base layer 20 resulting in a preferred image transfer blanket construction 15.

Figure 4:
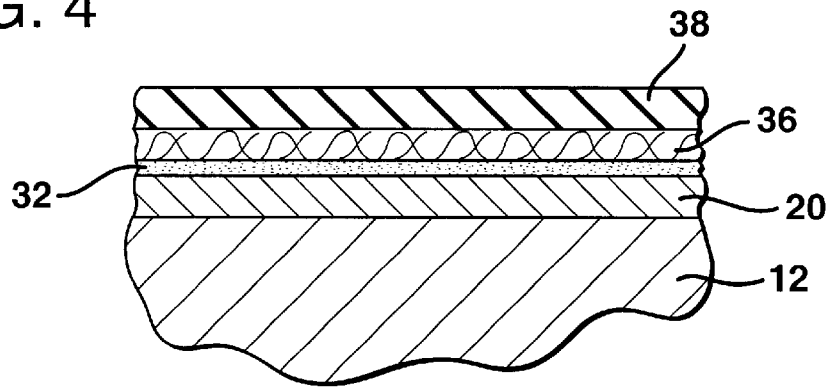
FIG. 4 is a fragmentary side view in cross-section of another embodiment of the image transfer blanket of the invention.

In another embodiment of the invention, shown in FIG. 4 and where like reference numerals represent like elements, image transfer blanket 15 has a simplified construction which includes an image transfer surface layer 38, a woven fabric ply 36, and a nonextensible backing layer 20. Again, the warp and weft fibers of fabric ply 36 are oriented such that the weft fibers extend circumferentially about blanket cylinder 12.

Figure 5:
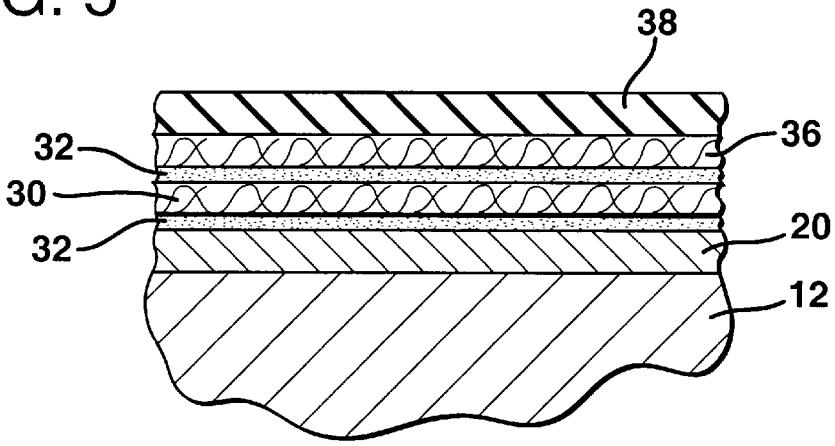
FIG. 5 is a fragmentary side view in cross-section of another embodiment of the image transfer blanket of the invention.

In yet another embodiment of the invention shown in FIG. 5, a smash resistant blanket construction is shown. Such a blanket includes a image transfer surface layer 38 and two woven fabric plies 36 and 30 adhered to nonextensible base layer 20. In this embodiment of the invention, one or both of the fabric plies have been impregnated with an elastomeric composition which displaces air from the interstices between the warp and weft fibers. This prevents the blanket surface from sinking when subjected to the compressive forces encountered during printing. A preferred method for impregnating the fabric plies is taught in commonly-assigned U.S. Pat. No. 5,498,470 to McLean et al, the disclosure of which is hereby incorporated by reference.

Figure 6:
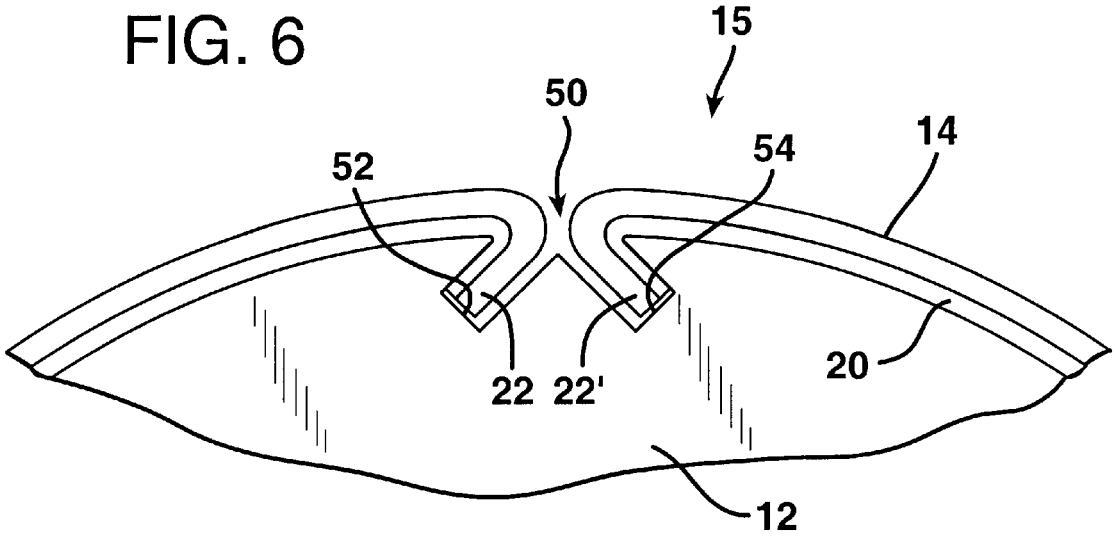
FIG. 6 is an enlarged view of a portion of another embodiment of the image transfer blanket of FIG. 1, showing additional detail of the blanket cylinder and axially-extending gap into which both ends of the image transfer blanket are mounted.

The blanket of the present invention may be secured to blanket cylinder 12 in a number of ways. FIGS. 6–14 illustrate several variations. Referring now to FIG. 6, an enlarged view of a portion of another embodiment of the image transfer blanket of FIG. 1 is shown with additional detail of the blanket cylinder and axially-extending gap into which both ends of the image transfer blanket are mounted. As illustrated, image transfer blanket 15 is mounted on blanket cylinder 12. Cylinder 12 includes an axially-extending gap 50 with a pair of angled channels 52, 54. Image transfer blanket 15 comprises a plurality of plies 14 nonextensible base layer 20. Blanket 15 includes first and second end portions 22 and 22', respectively. As seen in FIG. 6, image transfer blanket 15 is positioned on blanket cylinder 12 such that first and second end portions 22 and 22' are bent over the edges of cylinder 12 and inwardly into the gap 50. The end portions 22 and 22' extend into channels 52 and 54 and are bent inwardly into those channels at angles of substantially 135° with respect to the outer surface of the blanket cylinder 12. Again, it should be understood that other angles may be used without departing from the invention.

Figure 7:
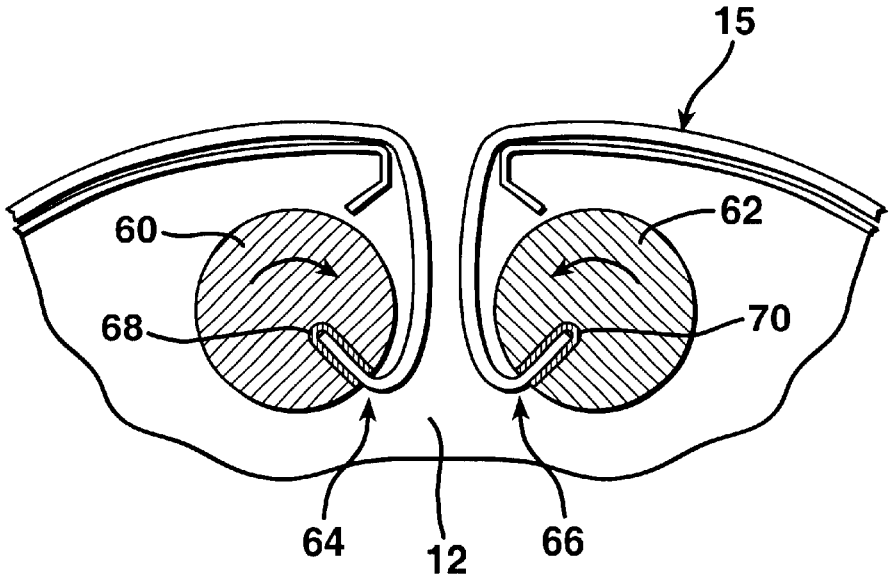
FIG. 7 is an enlarged schematic side view of another version of a lock up mechanism for the image transfer blanket.

Referring now to FIG. 7, an enlarged schematic side view of another version of a lock up mechanism for the image transfer blanket is shown. As shown, image transfer blanket 15 is mounted onto blanket cylinder 12 using a double reel lock-up mechanism. The mechanism includes a pair of rotatable, cylindrical locks 60 and 62 located on opposite sides of the gap in cylinder 12 and which include respective slots 64 and 66 therein. Blanket 15 includes blanket bars 68 and 70 which are secured to either end of blanket 15. Once blanket bars 68 and 70 are inserted into slots 64, 66, the locks are rotated in the direction show by the arrows to lock the blanket into position.

Figure 8:
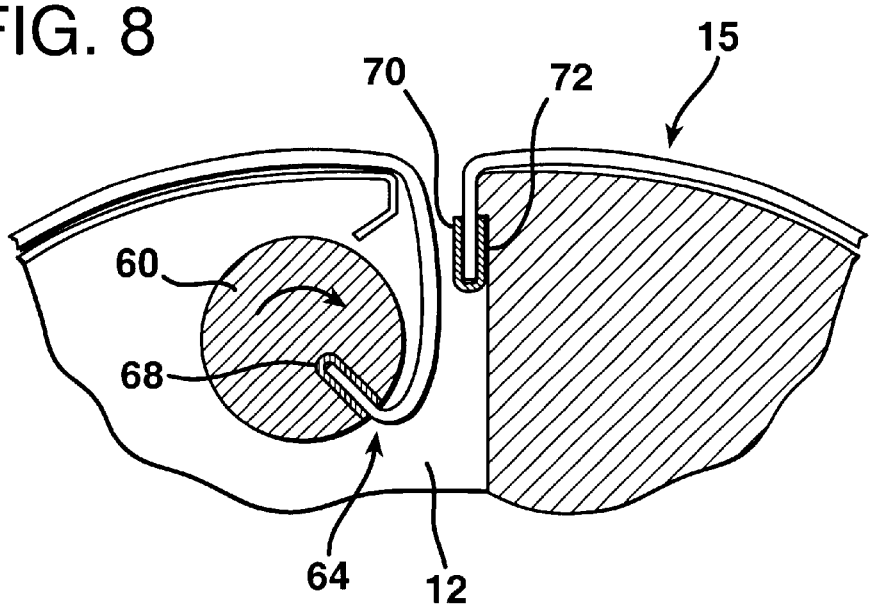
FIG. 8 is an enlarged schematic side view of yet another version of a lock up mechanism for the image transfer blanket.

FIG. 8 is illustrates another embodiment of the invention, an enlarged schematic side view of a single reel lock up mechanism for the image transfer blanket. As shown, image transfer blanket 15 is mounted onto blanket cylinder 12 using the lock-up mechanism. The mechanism includes a rotatable, cylindrical lock 60 which includes a slot 64 therein. On the opposite side of the gap in cylinder 12, is an indented ledge 72. Blanket 15 includes blanket bars 68 and 70 which are secured to either end of blanket 15. Once blanket bars 68 and 70 are inserted into slot 64 and ledge 72, the lock is rotated in the direction show by the arrow to lock the blanket into position.

FIGS. 9–14 illustrate different blanket bar treatments for the ends of blanket 15. As is known in the art, the configuration of the blanket bars on an image transfer blanket depends upon a number of factors including the type of press, the type of blanket cylinder, the type of lock-up mechanism, and the configuration of the blanket end. Typically, a blanket bar is an elongated V-shaped piece of metal having first and second laterally extending legs. The end of the blanket is inserted into the gap between the blanket bar legs, and the legs are compressed together to grip the blanket end. The surfaces of the legs of the blanket bar may include roughened areas, teeth, cut-out areas, etc. which act to increase the grip of the blanket bar on the blanket end so that the blanket end will not release during use.

Figure 9:
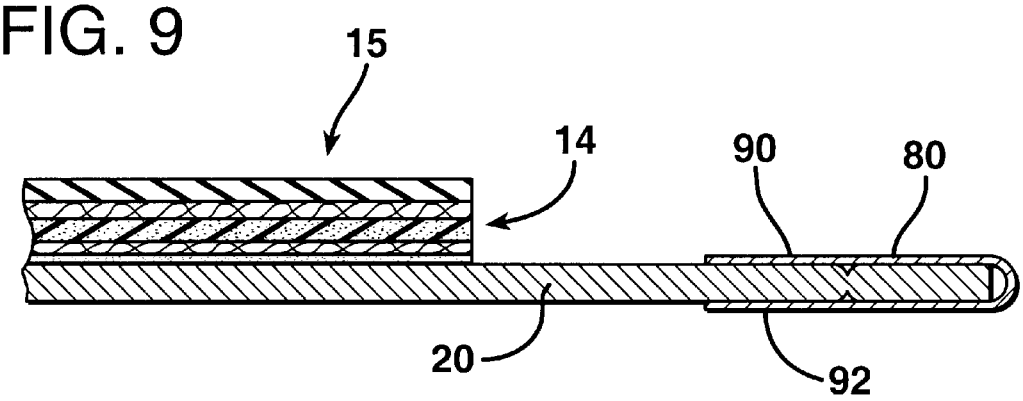
FIG. 9 is a schematic side view of one embodiment of a blanket bar secured to an end of the image transfer blanket.

FIG. 9 is a schematic side view of one embodiment of a blanket bar 80 secured to an end of the image transfer blanket 15. As shown, blanket 15 includes polymer and fabric layers 14 secured to an underlying nonextensible base layer 20. Base layer 20 extends beyond the end of plies 14 and is secured to the blanket bar 80. Blanket bar 80 includes first and second laterally extending legs 90, 92 which have been compressed together to grip the end of the blanket.

Figure 10:
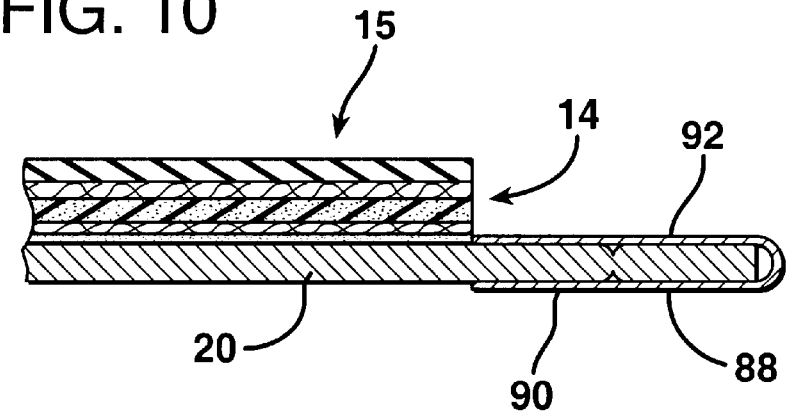
FIG. 10 is a schematic side view of another embodiment of a blanket bar secured to an end of the image transfer blanket.

FIG. 10 is a schematic side view of yet another embodiment of a blanket bar 88 secured to an end of the image transfer blanket 15. As shown, blanket 15 includes polymer and fabric layers 14 secured to an underlying nonextensible base layer 20. Base layer 20 extends beyond the end of plies 14 and is secured to the blanket bar 88. However, as compared to the embodiment shown in FIG. 9, in the FIG. 10 embodiment, blanket bar 88 abuts the end of plies 14.

Figure 11:
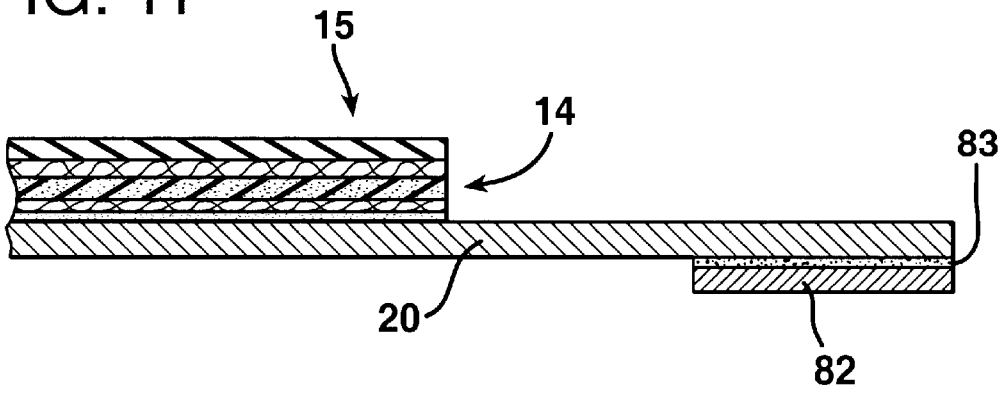
FIG. 11 is a schematic side view of another embodiment of a blanket bar secured to an end of the image transfer blanket.

FIG. 11 is a schematic side view of another embodiment of another blanket bar 82 secured to an end of the image transfer blanket 15. As shown in this embodiment, blanket 15 includes polymer and fabric layers 14 secured to an underlying nonextensible base layer 20. Base layer 20 extends beyond the end of plies 14 and is secured to the blanket bar 82, in this embodiment by adhesive 83. In this embodiment, blanket bar 82 is simply an elongated strip of metal which is secured on its one side to base layer 20.

Figure 14:
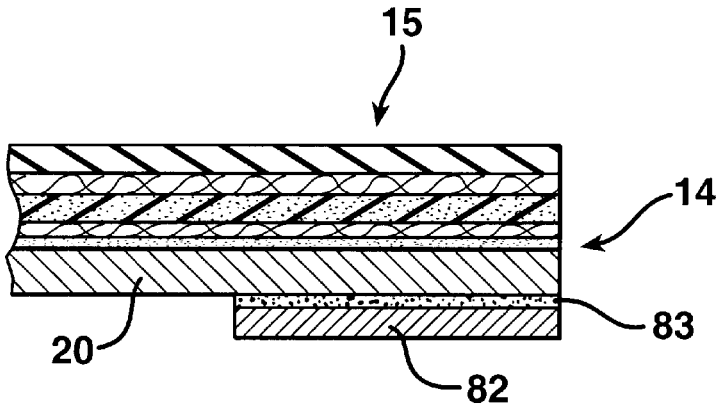
FIG. 14 is a schematic side view of yet another embodiment of a blanket bar secured to an end of the image transfer blanket.

FIG. 14 is also a schematic side view of another embodiment of the invention similar to the embodiment shown in FIG. 11, and where like numerals refer to like elements. However, in the embodiment of FIG. 14, base layer 20 is co-extensive with the end of plies 14 and is secured to the blanket bar 82 by adhesive 83. In this embodiment, blanket bar 82 is simply an elongated strip of metal which is secured on its one side to base layer 20.

Figure 12:
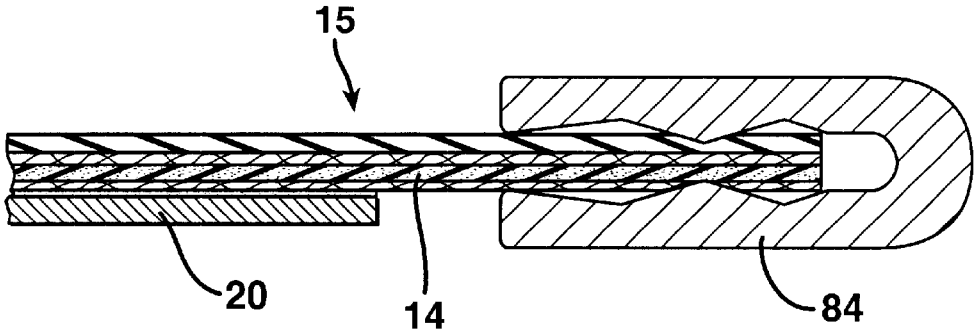
FIG. 12 is a schematic side view of yet another embodiment of a blanket bar secured to an end of the image transfer blanket.

FIG. 12 is a schematic side view of another embodiment of a blanket bar 84 secured to an end of the image transfer blanket 15. As shown in this embodiment, blanket 15 includes polymer and fabric layers 14 secured to an underlying nonextensible base layer 20. Plies 14 extend beyond the end of base layer 20 and are secured to the blanket bar 84.

Figure 13:
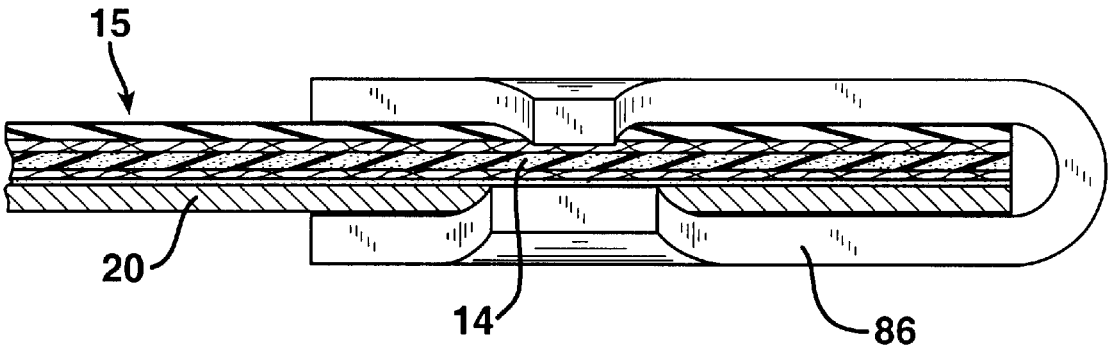
FIG. 13 is a schematic side view of yet another embodiment of a blanket bar secured to an end of the image transfer blanket.

FIG. 13 is a schematic side view of yet another embodiment of a blanket bar 86 secured to an end of the image transfer blanket 15. As shown in this embodiment, blanket 15 includes polymer and fabric layers 14 secured to an underlying nonextensible base layer 20. Plies 14 and base layer 20 are coextensive, and the end of the blanket is secured to the blanket bar 86.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. An image transfer blanket for a blanket cylinder which includes an axially-extending gap, said blanket including first and second ends, with at least one of said first and second ends being adapted to be inserted into said axially-extending gap in said blanket cylinder, said blanket comprising an image transfer surface layer, at least one woven fabric ply, and a nonextensible base layer, said at least one woven fabric ply including warp and weft fibers, said weft fibers being oriented so that when said blanket is mounted on said blanket cylinder said weft fibers extend circumferentially about said blanket cylinder.

2. An image transfer blanket as claimed in claim 1 further including at least one blanket bar secured to at least one end of said image transfer blanket.

3. An image transfer blanket as claimed in claim 1 including at least two woven fabric layers, with at least one of said woven fabric layers being oriented such that when said blanket is mounted on said blanket cylinder said weft fibers extend circumferentially about said blanket cylinder.

4. An image transfer blanket as claimed in claim 3 in which said at least two woven fabric layers are oriented such that when said blanket is mounted on said blanket cylinder said weft fibers in each of said woven fabric layers extend circumferentially about said blanket cylinder.

5. An image transfer blanket as claimed in claim 1 in which said base layer is selected from the group consisting of metals and alloys thereof, synthetic polymer resins, and fiber-reinforced synthetic polymer resins.

6. An image transfer blanket as claimed in claim 5 in which said base layer comprises steel.

7. An image transfer blanket as claimed in claim 5 in which said base layer comprises polyester.

8. An image transfer blanket as claimed in claim 5 in which said base layer comprises a polymer resin reinforced with fibers selected from the group consisting of glass, carbon, natural, and synthetic fibers.

9. An image transfer blanket as claimed in claim 8 in which said fibers comprise carbon fibers.

10. An image transfer blanket as claimed in claim 1 including a compressible layer.

11. An image transfer blanket for a blanket cylinder which includes an axially-extending gap, said blanket comprising an image transfer surface layer, a compressible layer, a first woven fabric ply positioned between said image transfer surface layer and said compressible layer, a nonextensible base layer, and at least a second woven fabric ply positioned between said compressible layer and said base layer, said second woven fabric ply including warp and weft fibers, said weft fibers being oriented such that when said blanket is mounted on said blanket cylinder said weft fibers extend circumferentially about said blanket cylinder.

12. An image transfer blanket as claimed in claim 11 in which said second woven fabric ply includes at least two woven fabric plies, each ply including warp and weft fibers, said weft fibers being oriented such that when said blanket is mounted on said blanket cylinder said weft fibers extend circumferentially about said blanket cylinder.

13. An image transfer blanket as claimed in claim 11 in which said first woven fabric ply includes warp and weft fibers, said weft fibers being oriented such that when said blanket is mounted on said blanket cylinder said weft fibers extend circumferentially about said blanket cylinder.

14. An image transfer blanket as claimed in claim 11 in which said base layer is selected from the group consisting of metals and alloys thereof, synthetic polymer resins, and fiber-reinforced synthetic polymer resins.

15. An image transfer blanket as claimed in claim 14 in which said base layer comprises steel.

16. An image transfer blanket as claimed in claim 14 in which said base layer comprises polyester.

17. An image transfer blanket as claimed in claim 14 in which said base layer comprises a polymer resin reinforced with fibers selected from the group consisting of glass, carbon, natural, and synthetic fibers.

18. An image transfer blanket as claimed in claim 17 in which said fibers comprise carbon fibers.

19. An image transfer blanket for a blanket cylinder which includes an axially-extending gap, said blanket including first and second ends, with at least one of said first and second ends being adapted to be inserted into said axially-extending gap in said blanket cylinder, said blanket comprising an image transfer surface layer, at least one woven fabric ply, and a nonextensible base layer, said at least one woven fabric ply including warp and weft fibers, said weft fibers being oriented so that when said blanket is mounted on said blanket cylinder said weft fibers extend circumferentially about said blanket cylinder, said nonextensible base layer extending beyond said image transfer surface layer and said woven fabric ply at at least one end thereof.

20. An image transfer blanket as claimed in claim 19 in which the portion of said nonextensible layer which extends beyond the at least one end of said blanket is bent such that such portion is adapted to be inserted into said axially-extending gap of said blanket cylinder.

21. An image transfer blanket as claimed in claim 19 in which the portion of said nonextensible layer which extends beyond the at least one end of said blanket has a blanket bar secured thereto.

22. An image transfer blanket as claimed in claim 20 in which the portion of said nonextensible layer which extends beyond the at least one end of said blanket has a blanket bar secured thereto.

23. An image transfer blanket as claimed in claim 21 in which said blanket bar comprises a strip of metal having first and second laterally extending legs.

24. An image transfer blanket for a blanket cylinder which includes an axially-extending gap, said blanket including first and second ends, with at least one of said first and second ends being adapted to be inserted into said axially-extending gap in said blanket cylinder, said blanket comprising an image transfer surface layer, at least one woven fabric ply, and a nonextensible base layer, said at least one woven fabric ply including warp and weft fibers, said weft fibers being oriented so that when said blanket is mounted on said blanket cylinder said weft fibers extend circumferentially about said blanket cylinder, said image transfer surface layer and said woven fabric ply extending beyond said nonextensible base layer at at least one end thereof.

25. A smash-resistant image transfer blanket for a blanket cylinder which includes an axially-extending gap, said blanket including first and second ends, with at least one of said first and second ends being adapted to be inserted into said axially-extending gap in said blanket cylinder, said blanket comprising an image transfer surface layer, at least one woven fabric ply, and a nonextensible base layer, said at least one woven fabric ply being impregnated with an elastomeric composition and including warp and weft fibers, said weft fibers being oriented so that when said blanket is mounted on said blanket cylinder said weft fibers extend circumferentially about said blanket cylinder.

* * * * *

UNITED STATES PATENT AND TRADEMARK OFFICE

CERTIFICATE OF CORRECTION

PATENT NO. : 6,530,321 B2
DATED : March 11, 2003
INVENTOR(S) : Andrew et al.

It is certified that error appears in the above-identified patent and that said Letters Patent is hereby corrected as shown below:

Column 4,
Line 36, “fibers and yams” should be -- fibers and yarns --;

Column 11,
Line 17, “Preferably, layer is” should be -- Preferably, layer 20 is --; and Column 12,
Lines 5, 15, 44 and 57, “being adapted to be inserted into” should be -- being insertable into --.

Signed and Sealed this

Twenty-seventh Day of July, 2004

JON W. DUDAS
*Acting Director of the United States Patent and Trademark Office*